343-909 SR
9/25/79 OR 4,169,268

United States Patent [19]
Schell et al.

[11] 4,169,268
[45] Sep. 25, 1979

[54] METALLIC GRATING SPATIAL FILTER FOR DIRECTIONAL BEAM FORMING ANTENNA

[75] Inventors: Allan C. Schell, Winchester; Robert J. Mailloux, Wayland, both of Mass.

[73] Assignee: The United States of America as represented by the Secretary of the Air Force, Washington, D.C.

[21] Appl. No.: 904,964

[22] Filed: May 11, 1978

Related U.S. Application Data

[63] Continuation-in-part of Ser. No. 678,516, Apr. 19, 1976, abandoned.

[51] Int. Cl.[2] ..... H01Q 15/10
[52] U.S. Cl. ..... 343/909
[58] Field of Search ..... 343/753, 754, 755, 872, 343/909, 911 R

[56] References Cited

U.S. PATENT DOCUMENTS

| | | | |
|---|---|---|---|
| 2,684,725 | 7/1956 | Kock | 343/909 |
| 2,756,424 | 7/1956 | Lewis et al. | 343/909 |
| 2,763,860 | 9/1956 | Ortusi et al. | 343/753 |
| 3,708,796 | 1/1973 | Gilbert | 343/909 |

FOREIGN PATENT DOCUMENTS

| | | | |
|---|---|---|---|
| 1058285 | 3/1954 | France | 343/754 |
| 665747 | 1/1952 | United Kingdom | 343/753 |

*Primary Examiner*—Eli Lieberman
*Attorney, Agent, or Firm*—Joseph E. Rusz; Willard R. Matthews

[57] ABSTRACT

Sidelobe suppression and other beam transmission property manipulations in directional beam forming antennas is accomplished by means of a spatial filter. The filter geometry consists of a plurality of metallic gratings separated by air or other low dielectric constant dielectric substance. The filter is placed directly over the antenna radiating aperture and is encompassed by a tunnel structure of electromagnetic wave energy absorbing material. The shunt susceptance characteristics of the metallic gratings together with the integrating spacing distances are synthesized in a manner that effects full transmission of beam power in a selected beam direction while offering substantial rejection of it in other directions.

7 Claims, 11 Drawing Figures

METALLIC GRATING SPATIAL FILTER FOR DIRECTIONAL BEAM FORMING ANTENNA

STATEMENT OF GOVERNMENT INTEREST

The invention described herein may be manufactured and used by or for the Government for governmental purposes without the payment of any royalty thereon.

This is a continuation-in-part of co-pending patent application Ser. No. 678,516 entitled *Metallic Grating Spatial Filter For Directional Beam Forming Antenna,* filed by Allan C. Schell and Robert J. Mailloux, Apr. 19, 1976, now abandoned.

BACKGROUND OF THE INVENTION

This invention relates to directional beam forming antennas, and in particular to metallic grating type spatial filters for suppressing the sidelobes of beams transmitted by such antennas.

The performance of phased arrays and other directional beam forming antennas is often degraded by the presence of sidelobes and grating lobes in the transmitted beam. A particular problem is represented by the residual grating lobes that plague limited sector scanning and multiple beam arrays in airport precision-approach radar systems and synchronous satellite communications antennas. In the past, for each individual case, sidelobe problems have been overcome by redesigning the antenna. Such an approach is, of course, both inflexible and expensive. A substantial improvement on previous techniques dealing with this problem is disclosed in our co-pending patent application Ser. No. 678,516, filed Apr. 19, 1976, entitled "METALLIC GRATING SPATIAL FILTER FOR DIRECTIONAL BEAM FORMING ANTENNA". However, while the layered dielectric filter described therein avoids the need to redesign the antenna for each application, its weight and cost could be improved upon.

The present state-of-the-art also includes filters comprised of multiple parallel metallic gratings. Typical of this type of filter is the device shown in U.S. Pat. No. 2,763,860 entitled *HERTZIAN OPTICS,* issued to A. Ortusi et al, Sept. 18, 1950. Devices of this type, however, focus the transmitted beam and do not necessarily eliminate sidelobe and other unwanted portions of the beam in the manner desired.

The present invention is directed toward providing a spatial filter that retains the advantages of the layered dielectric filter without focusing the beam and at the same time significantly reducing cost and weight requirements.

SUMMARY OF THE INVENTION

The invention is a spatial filter composed of nonresonant metallic gratings separated by air spaces or various materials with low dielectric constant. It comprehends selected geometries with equal or unequal integrating distances and with the same or different grating structures as can be designed or synthesized by wave propagation and polynomial synthesis. The filter is intended for use with a phased array or with any antenna that forms a directional beam in space. The purpose of the filter is to provide good transmission for radiation in the direction of the main beam and substantial rejection for radiation at angles outside the sector or cone of coverage swept by the main beam.

It is a principal object of the invention to provide new and improved means for suppressing sidelobes in beams transmitted by directional beam-forming antennas.

It is another object of the invention to provide a metallic grating type spatial filter adapted to suppress sidelobes and grating lobes in beams transmitted by directional beam-forming antennas.

It is another object of the invention to provide a greatly simplified, lightweight, inexpensive means for suppressing sidelobes and grating lobes.

These, together with other objects, features and advantages of the invention, will become more readily apparent from the following detailed description when taken in conjunction with the illustrative embodiment in the accompanying drawings.

Figure 7:
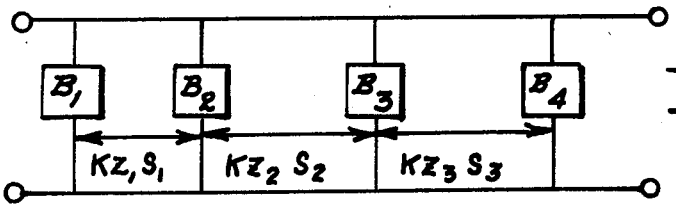
Figure 8:
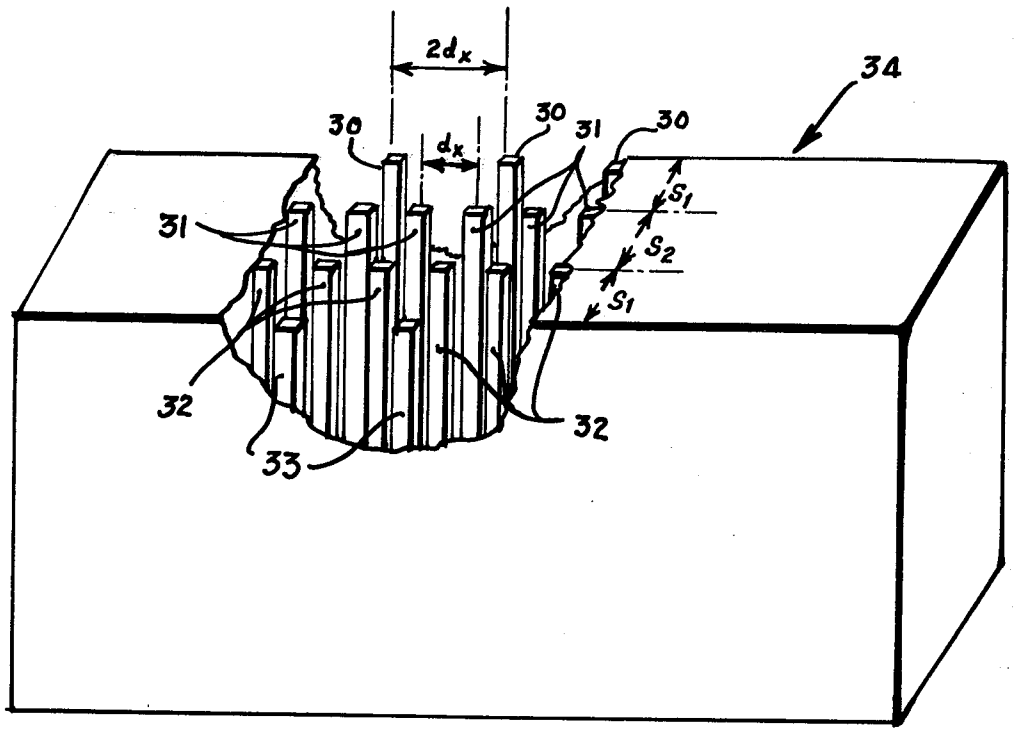
Figure 9:
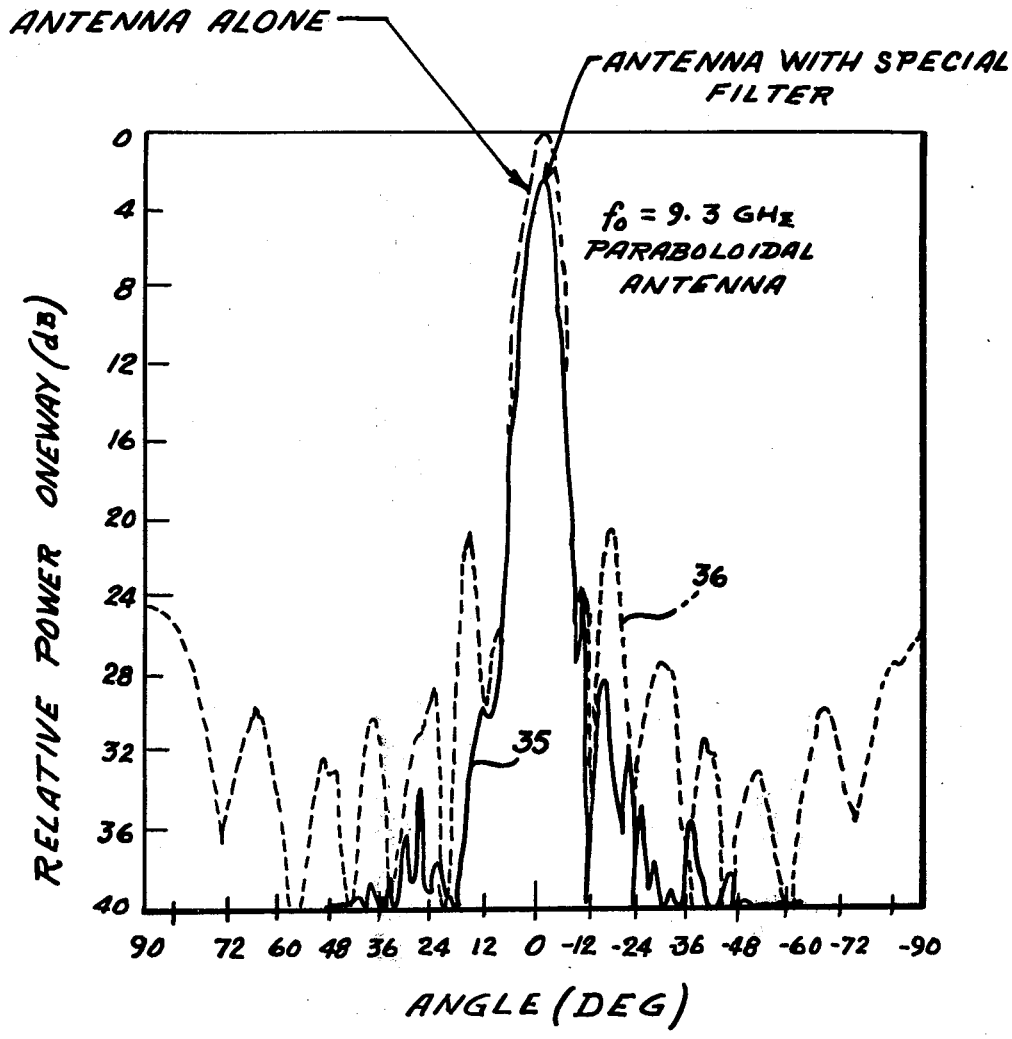

FIG. *6a, 6b* and *6c* illustrate three different types of metallic gratings that are suitable to use in the filter of the invention;

FIG. 7 is an equivalent circuit for spatial filtering;

FIG. 8 is a partially cut away isometric view of an example of the invention; and FIG. 9 is a graph showing the field patterns of a parabaloidal antenna using the filter of the invention.

DETAILED DESCRIPTION OF THE PREFERRED EMBODIMENT

Figure 1:
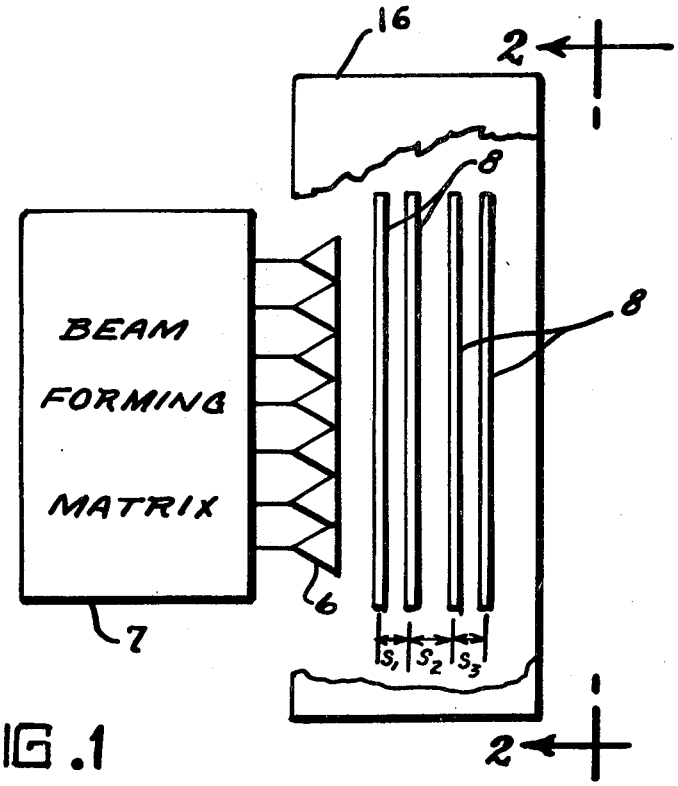
FIG. 1 illustrates one presently preferred embodiment of the invention.
Figure 2:
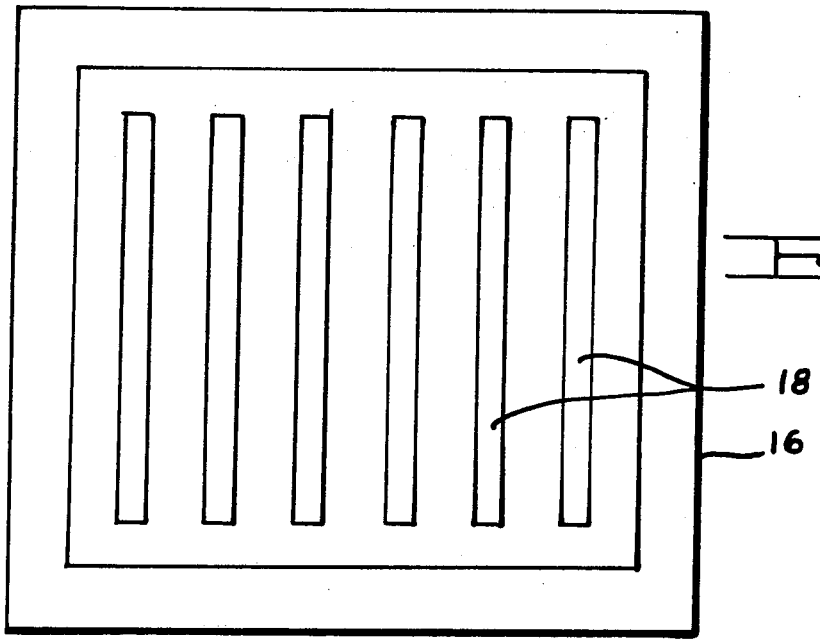
FIG. 2 is a frontal view of the embodiment of FIG. 1.

The essential elements of a spatial filter incorporating the principles of the invention are shown in the presently preferred embodiment of FIGS. 1 and 2. The filter is shown in relationship to a directional beam-forming antenna comprising the array of radiating elements 6 and beam-forming matrix 7. The filter of the invention, however, will operate in the same manner whether the antenna behind it is an array, a parabola or any other antenna. The spatial filter of the invention comprises the structural arrangement of juxtaposed metallic gratings 8 separated by air or other dielectric medium at distances $S_1$, $S_2$, $S_3$. A tunnel 16 of electromagnetic wave energy absorbent material (shown partially cut away to expose gratings 8) is positioned around the filter. Tunnel 16 can be square or annular with open ends with a suitable wave absorbent surface geometry. It can be fabricated of carbon inpregnated foam or other suitable material. In practice the filter and tunnel can be mounted in appropriate relationship to the antenna radiating aperture by means of a frame or brackets (not shown).

Figure 3:
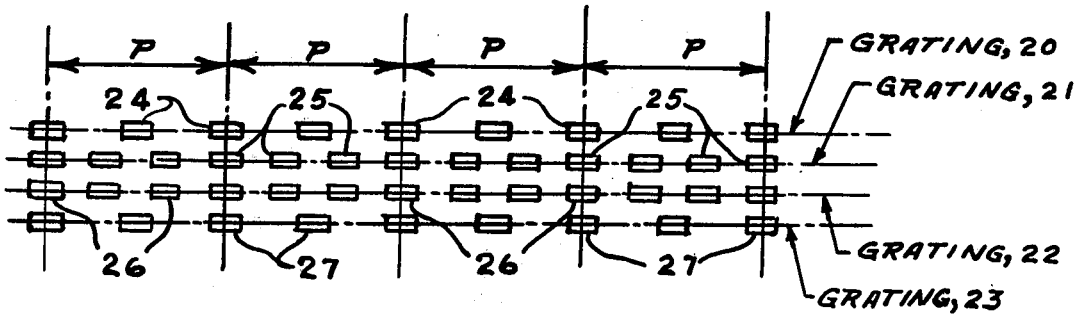
FIG. 3 is a plan view of four gratings illustrating their commensurate periodicities.
Figure 5:
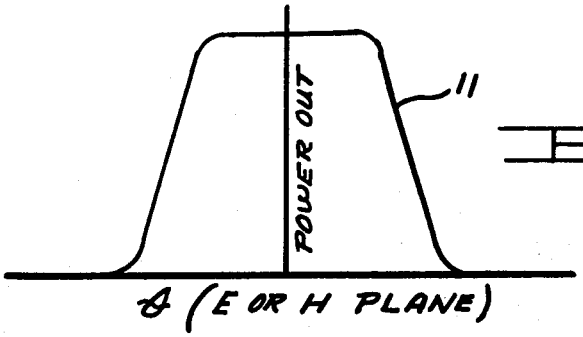
FIG. 5 is a typical field pattern for a beam transmitted through a filter incorporating the principles of the invention.

Certain constraints are necessary in order to produce an operative device. The first constraint is that each grating should have the same periodicity or commensurate periodicity as every other grating. This means that the wire (or hole) spacings or the spacing between a repeated pattern of wires or holes in one grating are the same as the wire spacings between a repeated pattern of wires in any other gratings. This concept is illustrated by FIG. 3 which shows an end view of four rows of grating elements 24–27. These rows of grating elements form gratings 20, 21, 22, 23. Outer gratings 20, 23 have fewer grating elements than inner gratings 21, 22 but the repeating pattern of all gratings is such that they coincide or are in register at certain periods P. It is a second constraint that the periodicity (P) of the gratings be substantially equal to or less than $\lambda/2$ where $\lambda$ is the wavelength at the operating frequency of the filter. The foregoing requirements are necessary because the filter of the invention is not intended to focus the energy. The invention operates by simply rejecting (reflecting) the energy coming from outside the desired pass band. It is therefore also required that the overall dimensions of all gratings be the same. Otherwise the structure would focus the beam like a dielectric lens and would be equivalent to a metal grid lens.

The present invention differs from that disclosed in our copending patent application, Ser. No. 678,516, in that it uses nonresonant metallic gratings in place of the dielectric layers. The metallic gratings act like a shunt susceptance to any incident wave, and by using a multitude of these gratings, each separated by appropriate spacings, proper filter patterns can be synthesized using the mathematics of conventional frequency filter synthesis. The fundamental distinction made is that the nonresonant grating structure represents a new element that can be used in a spatial filter in place of a dielectric layer, and that the filter thus synthesized has different electrical and mechanical characteristics than a dielectric layer filter; specifically, it introduces the mechanical advantages of lighter weight and lower cost.

As distinct from the work of Ortusi, et al and other existing devices, the principle of operation of this filter is to reject radiation that does not fall within the specified angular pass band, not to focus it. Because of this the filter is used in the presence of an absorbing tunnel to suppress stray radiation in the area of 70° to 100° from the perpendicular to the filter. In this regard it is noted that prior art devices do not use any absorber because all the energy is focused. However, the present invention can provide far steeper filter characteristics than can be designed following the prior art.

Furthermore, since the present device is not a lens, and does not focus, the same choice of layer thickness, spacings, etc., is true for a large or small aperture. Alternatively the device like those of the prior art must have a radial variation if they are more than a few wavelengths across.

Figure 4:
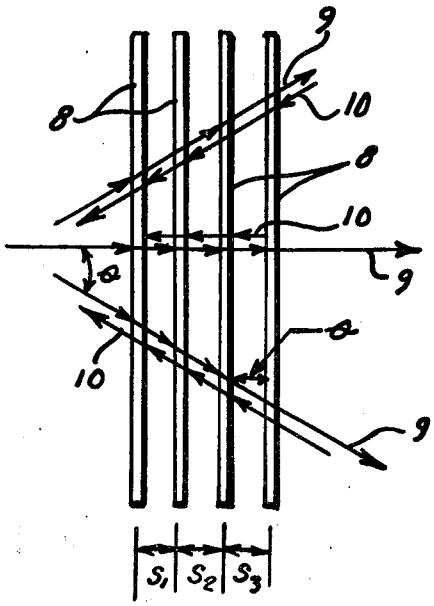
FIG. 4 is a schematic representation illustrating the relationship between a filter of the type comprehended by the invention and a beam at various beam angles.

FIG. 4 illustrates the combination of a number of nonresonant metallic gratings 8 to found a structure that either transmits or reflects energy depending upon the incident angle of impinging radiation. The beam 9 in this instance is intended to be fully transmitted at broadside and rejected at a certain angle off broadside. The metallic gratings are therefore spaced such that beam energy 10 reflected by the metallic gratings exactly cancels out at broadside. It can be seen from the geometry of FIG. 2 that energy reflected when the beam is at an angle $\theta$ travels a longer distance than when the beam is at broadside and would not exactly cancel. By proper design such reflected energy can be made to add, resulting in rejection of the transmitted beam at and beyond beam excursion limits. One primary use of the filter arrangement is to suppress the sidelobes of an antenna over certain regions of space without altering its radiation pattern near the main beam. Typical angular transmission characteristics, as shown by curve 11 at FIG. 3, have a relatively narrow angular pass band and offer substantial rejection to a signal impinging from any angle beyond the pass band.

Figure 6A:
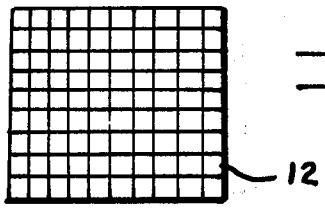
Figure 6B:
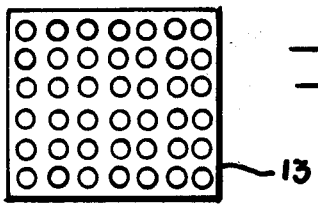
Figure 6C:
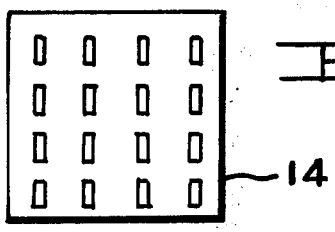

The basic configuration of the invention as shown in FIGS. 1 and 2 consists of a number of metallic gratings or grids separated by air spaces or by some dielectric medium. The grids may be of the type developed for radome use or for use as elements of a frequency filter, but should not in general be resonant at the spatial filter operating frequency. Several examples of possible gratings are shown by metallic grids 12, 13, and 14 of FIGS. 6a, 6b, and 6c, respectively. The gratings are shunt susceptances as viewed by the wave passing through them, and the combination of a number of such gratings produces the spatial resolving action of the filter. The electrical path length between any two gratings separated by the distance "S" is given by:

$$k_z S = \frac{2\pi}{\lambda_o} S \cos = \frac{2\pi f}{C} S \cos\theta \qquad (1)$$

for the angle $\theta$ measured from the perpendicular to the plane of the layers as shown in the figures. Accordingly, any metallic obstacle whose equivalent circuit is described as a shunt susceptance to the incoming wave ban be a suitable metallic grid. These can be plates with periodic holes, screens or periodic metal deposits on teflon or plastic sheets. In any case the largest periodicity (commensurate or otherwise) must be approximately equal to or less than a half wavelength.

Conventional frequency filters use susceptive elements separated by lengths of transmission line, and the variation of the line propagation constant $k_2$ with frequency "f" allows the design of filters with frequency as variable. Similarly, the above equation shows that for fixed frequency the electrical length of the space between susceptive gratings varies with the angle $\theta$, and so spatial filter behavior can be synthesized using the parameter $\cos\theta$ as variable.

The equivalent circuit for spatial filtering shown in FIG. 7 depicts a filter with a number of susceptive gratings separated by line lengths. The susceptances (B) and line lengths can be equal or unequal as dictated by the particular filter design selected. Synthesis can be carried out using the conventional methods with the parameter $\cos\theta$ replacing the usual frequency variable. These methods are described in detail in the periodical articles "MICROWAVE FILTERS USING OUARTER-WAVE COUPLINGS", by R. M. Fine and A. W. Lawson, *IRE Proceedings,* Vol. 35, Nov. 1947, pp 1318–1323; "MICROWAVE FILTER THEORY AND DESIGN" by J. Hessel et al, *IRE Proceedings,* Vol. 37, September 1949, pp 990–1000; and "MAXIMALLY-FLAT FILTERS IN WAVEGUIDE" by W. W. Mumford, *Bell System Technical Journal,* Vol. 27, 1948, pp 684–713. These references provide data for appropriate design of narrow and broad spatial pass bands with specified rejection ratios in the angular stop bands. Similary the literature of metallic gratings make it possible to characterize the gratings by the shunt susceptance to an incoming wave. Typical of such literature are the Periodical articles:

DIFFRACTION OF ELECTROMAGNETIC WAVES BY A CONDUCTING SCREEN PERFORATED PERIODICALLY WITH CIRCULAR HOLES, IEEE Trans. NTT Vol. 19, No. 5, May 1971, pp 475–481; by C. C. Chen;

TRANSMISSION THROUGH A TWO-LAYER ARRAY OF LOADED SLOTS, by B. A. Monk, et al, *IEEE Trans.* AP22, No. 6, Nov. 1974, pp 804–809;
A STREAMLINED METALLIC RADOME, by E. L. Felton and B. A. Monk, *IEEE Trans.* AP22, No. 6, Nov. 1974, pp 799,803;
PLANE WAVE REFLECTION FROM A RECTANGULAR MESH GROUND SCREEN, by G. A. Otteni, *IEEE Trans.* AP21, No. 6, November 1973, pp 843–851;
SCATTERING BY A PERIODICALLY APERTURED CONDUCTING SCREEN, *IEEE Trans.* AP8, No. 6, November 1961, pp 506–514, by R. B. Kieburtz and A. Ishimaru;
A STUDY OF THE ARRAY OF SQUARE OPENINGS, *Applied Optics,* Vol. 9, No. 10, October 1970, pp 2341,2349, By R. J. Bell.

By way of example a specific embodiment of the invention is shown in FIG. 8. This figure shows a filter with four rows of metal strips. It comprises a first outer row of metal strips 30, a first inner row of metal strips 31, a second inner row of metal strips 32, a second outer row of metal strips 33, and low dielectric constant spacer material 34. The outer two layers have strips spaced $2d_x$ apart, where $d_x=0.1866\lambda$. The inner layers are spaced $d_x$ apart. All strips are 0.0315 wide and are on the order of $0.0001\lambda$ thick. Spacings $S_1$ and $S_2$ are: $0.453\lambda$ and $0.481\lambda$.

The filter is intended for a single E plane polarization requiring only the single row arrangement of metal strips shown. Dual linear polarization or circular polarization applications would of course require a structure similar to that of FIG. 6a or the like. It is noted that in this case the outer strips have twice the period or separation ($d_x$) of the inner strips. They could have the same period, with different stripwidths, or they could have some multiple of the same width, so that, for example $3d_{x1}$ would be equal to $2d_{x2}$. Such periods are called commensurate, and the period of the hole periodic structure is the distance $3d_x$, must be less than or approximately equal to one half wavelength for the technique not to produce focusing.

The procedure for the filter design is nearly identical to conventional procedures for frequency filter design with the exception that the angle of incidence $\theta$ plays a dominant role in determining the electrical spacing variation. Accordingly, the design can use nearly any of the published procedures describing filter synthesis for waveguide or transmission line filters made up of shunt susceptances separated by lengths of line. The following is an example adapted from the book *Microwave Filters, Impedance-Matching Networks and Coupling Structures* by G. L. Mattaei, Leo Young and E. M. T. Jones, McGraw Hill Book Co., (1964).

Procedure: to design a four-element Chebyshev Filter with 0.2 dB ripple, pass band limits $\pm 12°$.

Following the procedure in the reference, Section 8.06 for Shunt-Inductance Coupled, Waveguide Filters (p 450, etc.)

At 9.3 GHz $\lambda_0=1.27''$

Table 4.05-2(a) Page 100 gives the filter element (values for 0.2 dB ripple (for $n=3$) as:

$g_0=g_4=1.0$ (Free space normalization)

$g_1=g_3=1.2275$ $g_2=1.1525$

The electrical distance between elements separated by the distance s is $$2n\frac{S}{\lambda_f}=\frac{2\pi S}{\lambda_o}\cos\theta$$

so that the equivalent $\lambda_f$ in the filter is $$\lambda_f=\lambda_0/\cos\theta.$$

Since $\cos 12°=0.978$ the effective wavelength at the pass band edge is $$\lambda_2=\lambda_0(1/\cos 12°)=1.298''$$

and at the other pass band edge $$\lambda_1=1.242''.$$

The guide wavelength fractional bandwidth $w\lambda$ is thus 0.0441. Defining $co_1=1$, one can use equation 1–8 of Figure 8.06-1 in the referenced to obtain values for the parameters $$K_{01}/Z_0=0.2376;\ X_{01}/Z_0=1.252$$

and so $$B_1/Y_0=4$$

and $$K_{12}/Z_0=0.0592,\ X_{12}/Z_0=0.0594$$

and thus $$B_2/X_0=16.8$$

and $\theta_1=2.849$ (Spacing $S_1=0.453\ \lambda_0$)
and $\theta_2=3.0237$ (Spacing $S_2=0.481\ \lambda_0$).

Having defined the values $B_1/Y_0$ and $B_2/Y_0$, which are the normalized susceptances of the metal grid, all that remains is to find the appropriate grid yielding that susceptance. The numbers below were taken from the *Waveguide Handbook,* Marcuvitz (McGraw Hill Book Co., P284)

$B_2/Y_0=4$ is obtained for strips of width $0.0315\ \lambda_0$, separated $0.1866\ \lambda_0$ apart.

$B_2/Y_0=16.8$ is obtained from strips of width 0.0315 $\lambda_0$ separated $0.0933\ \lambda_0$.

FIG. 9 shows the pattern of a small parabola with (curve 35) and without (curve 36) a filter and indicates the sort of sidelobe suppression that can be achieved with filters of the type completed by the inventor.

While the invention has been described in its preferred embodiment, it is understood that the words which have been used are words of description rather than words of limitation and that changes within the purview of the appended claims may be made without departing from the scope and spirit of the invention in its broader aspects.

What is claimed is:

1. A spatial filter for a directional beam forming antenna comprising a plurality of spaced, juxtaposed planar periodic metallic structures positioned proximate to said antenna and in intercepting relationship with electromagnetic wave energy transmitted and received thereby, said planar periodic metallic structures being separated by dielectric medium and spaced at distances that effect substantially complete cancellation of electromagnetic wave energy reflected by said planar metallic periodic metallic structures for a given beam direction, said planar periodic metallic structures being commensurate and in register at periodic intervals, the periodicity of said periodic intervals being not more than one half wavelength, and each said planer periodic metallic structure having an equivalent circuit that presents a shunt susceptance to electromagnetic wave energy received thereby.

2. A spatial filter for a directional beam forming antenna as defined in claim 1 wherein said planar periodic metallic structures are non-resonant at the filter operating frequency.

3. A spatial filter for a directional beam forming antenna as defined in claim 1 wherein said planar periodic metallic structures are metallic gratings.

4. A spatial filter for a directional beam forming antenna as defined in claim 1 wherein said planar periodic metallic structures are metallic sheet member having periodically disposed apertures therein.

5. A spatial filter for a directional beam forming antenna as defined in claim 3 wherein the grating element dimensions and spacings for all gratings are alike.

6. A spatial filter for a directional beam forming antenna as defined in claim 3 wherein the grating element dimensions and spacings for all gratings are not alike.

7. A spatial filter for a directional beam forming antenna as defined in claim 1 including an electromagnetic wave energy absorbing tunnel member in peripheral relationship to said spaced juxtaposed planar periodic metallic structures.

* * * * *